US011491675B2

(12) United States Patent
Dwire et al.

(10) Patent No.: US 11,491,675 B2
(45) Date of Patent: Nov. 8, 2022

(54) REMOVABLE END WEIGHT FOR SLICER

(71) Applicant: Globe Food Equipment Co., Dayton, OH (US)

(72) Inventors: Heather Brianna Dwire, New Lebanon, OH (US); Bethany Nicole Farrier, Dayton, OH (US)

(73) Assignee: Globe Food Equipment Co., Dayton, OH (US)

( * ) Notice: Subject to any disclaimer, the term of this patent is extended or adjusted under 35 U.S.C. 154(b) by 0 days.

(21) Appl. No.: 17/118,904

(22) Filed: Dec. 11, 2020

(65) Prior Publication Data

US 2021/0221016 A1 Jul. 22, 2021

Related U.S. Application Data

(60) Provisional application No. 62/962,383, filed on Jan. 17, 2020.

(51) Int. Cl.

| | |
|---|---|
| ***B26D 7/01*** | (2006.01) |
| ***B26D 1/143*** | (2006.01) |
| ***B26D 7/06*** | (2006.01) |

(52) U.S. Cl.

CPC ..... *B26D 7/01* (2013.01); *B26D 1/143* (2013.01); *B26D 7/0616* (2013.01); *B26D 2210/02* (2013.01)

(58) Field of Classification Search

CPC ..... B26D 7/02; B26D 7/0608; B26D 7/01; B26D 1/143; B26D 7/0616; B26D 2210/02; Y10T 83/6508; Y10T 83/6536; Y10T 83/654; Y10T 83/6579; Y10T 403/32508; B25G 1/04; B25G 3/16

See application file for complete search history.

(56) References Cited

U.S. PATENT DOCUMENTS

| | | | | |
|---|---|---|---|---|
| 1,803,261 A | | 4/1931 | Kubis | |
| 2,021,794 A | | 11/1935 | Leone | |
| 2,820,655 A | * | 1/1958 | Hileman | F16B 7/20 403/349 |

(Continued)

FOREIGN PATENT DOCUMENTS

| | | |
|---|---|---|
| DE | 30 13 468 A1 | 3/1981 |
| EP | 3 184 267 B1 | 2/2018 |

(Continued)

OTHER PUBLICATIONS

International Search Report for PCT/US2020/064510, dated Mar. 31, 2021, 3 pp.

*Primary Examiner* — Jonathan G Riley
(74) *Attorney, Agent, or Firm* — Crowell & Moring LLP

(57) ABSTRACT

A rotating blade slicer is provided. The slicer includes a housing, a carriage assembly that is slidably movable along the housing with respect to the knife. A gauge plate is provided to set cutting depth. The carriage assembly movably supports a weighted plate that is slidably mounted upon the carriage assembly and is configured to be disposed upon an upper surface of a food product intended to be sliced by the knife. The weighted plate supported by an arm that is slidably mounted to the carriage assembly, wherein the weighted plate is removably attached to the arm such that the weighted plate can be removed from and connected to the arm without any external tools.

16 Claims, 9 Drawing Sheets

(56) References Cited

U.S. PATENT DOCUMENTS

| | | | | |
|---|---|---|---|---|
| 4,306,743 | A * | 12/1981 | Hinshaw | F16L 37/248 285/260 |
| 10,492,646 | B2 | 12/2019 | Al Qudah | |
| 2003/0079595 | A1 * | 5/2003 | Shariff | B26D 7/02 83/713 |
| 2006/0150791 | A1 | 7/2006 | Chase et al. | |
| 2010/0089254 | A1 | 4/2010 | Gosis et al. | |
| 2021/0221016 | A1 | 7/2021 | Dwire | |

FOREIGN PATENT DOCUMENTS

| | | |
|---|---|---|
| GB | 322818 | 9/1928 |
| WO | 2007/024604 A1 | 1/2007 |

* cited by examiner

REMOVABLE END WEIGHT FOR SLICER

CROSS-REFERENCE TO RELATED APPLICATIONS

This application claims priority to U.S. Provisional Application Ser. No. 62/962,383 filed Jan. 17, 2020, the entirety of which is incorporated herein by reference.

BACKGROUND

This disclosure is related to rotating blade slicers, which may have manual or automatic functionality. Slicers typically include a carriage assembly that reciprocates with respect to a housing that rotatably supports a knife or cutting blade. The housing further includes a gauge plate, which is movable with respect to the knife with the parallel distance between the knife and the gauge plate establishing the slice thickness of the slice cut of the food product disposed upon the carriage assembly. The carriage assembly may include a weighted plate that is provided to rest upon the top of the food product disposed upon the carriage assembly and the engagement with the food product assists with maintaining the food product resting upon the carriage assembly and also sliding along the gauge plate as the carriage assembly is moved (manually or automatically with respect to the knife). It is important that all components of a slicer that interact with food be cleaned at set intervals during use.

BRIEF SUMMARY

A first representative embodiment of the disclosure is provided. The embodiment includes a rotating blade slicer. The slicer includes a housing that rotatably supports a knife that is configured to rotate in operation of the slicer and a carriage assembly that is slidably movable along the housing between a first position where the carriage assembly is forward of the knife and a second position where the carriage assembly is disposed over the knife. A gauge plate is adjustably mounted to the housing, a position of the gauge plate adjustable between a position where the gauge plate is aligned with a plane through the knife and a plurality of positions where the gauge plate is positioned parallel to the plane through the knife with a distance between a second plane through the gauge plate and the plane through the knife. The carriage assembly movably supports a weighted plate that is slidably mounted upon the carriage assembly and is configured to be disposed upon an upper surface of a food product intended to be sliced by the knife. The weighted plate is supported by an arm that is slidably mounted to the carriage assembly, wherein the weighted plate is removably attached to the arm such that the weighted plate can be removed from and connected to the arm without any external tools, while providing a non-complex set of structures that can readily be cleaned according to food-safety standards. The embodiments described herein address this need/problem of providing a weighted plate that can readily be mounted, securely operated, and readily removed (e.g., for storage or cleaning) without use of external tools and providing structure that can readily be cleaned in keeping with food safety standards.

Other systems, methods, features and advantages of the invention will be, or will become, apparent to one with skill in the art upon examination of the following figures and detailed description. It is intended that all such additional systems, methods, features, and advantages be within the scope of the invention, and be encompassed by the following claims.

DETAILED DESCRIPTION OF THE DRAWINGS AND THE PRESENTLY PREFERRED EMBODIMENTS

Figure 1:
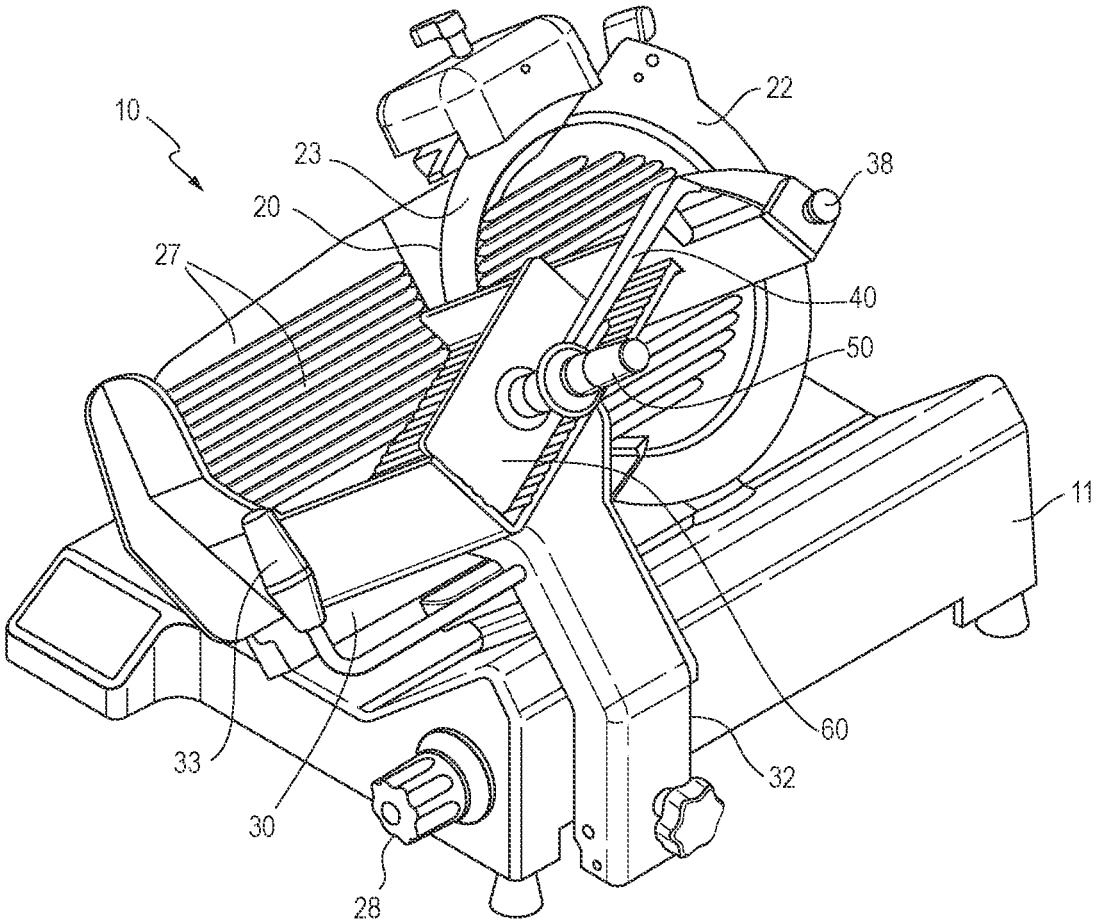
FIG. 1 is a perspective view of a product slicer showing the weighted plate in an upper position.
Figure 2:
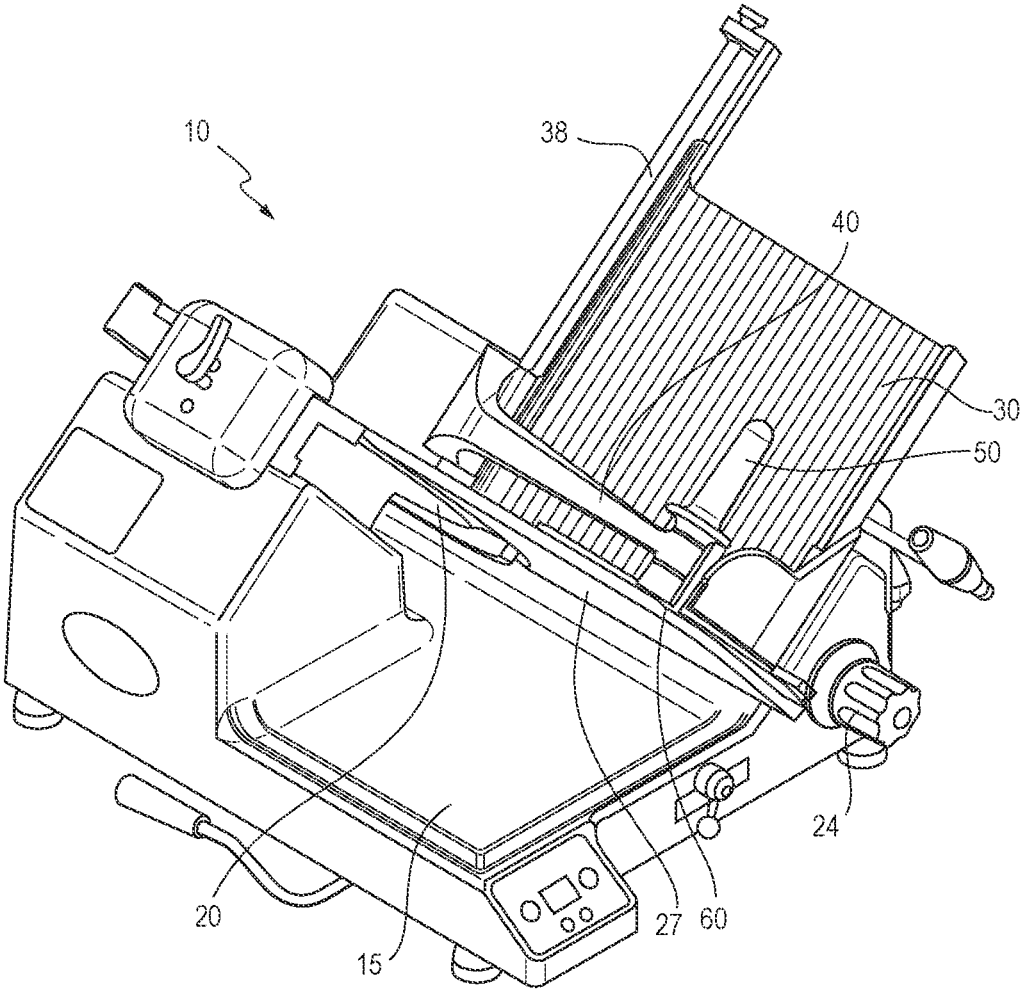
FIG. 2 is another perspective view of the product slicer of FIG. 1 showing the weighted plate in a lower position.
Figure 3:
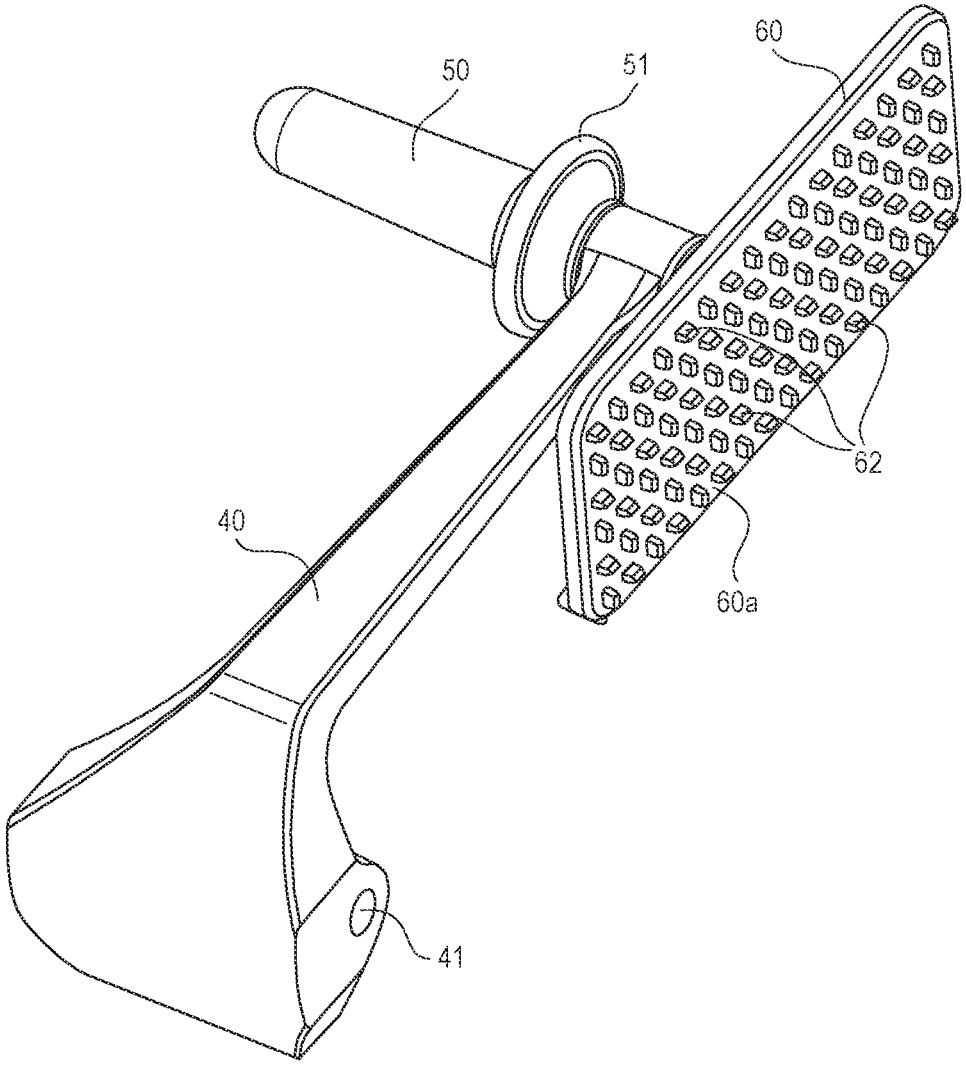
FIG. 3 is a perspective view of an arm and weighted plate of the product slicer of FIG. 1.

Turning now to FIGS. 1-11 a product slicer 10 is provided. The slicer 10 has a housing 11 that acts as external shell of the product slicer and supports and/or encloses the various commonly known mechanical components of a reciprocating slicer (either automatic or manual) as well as enclosing various electrical components, such as a motor, controller and other components known to be used in conventional manual or automatic slicers 10.

In addition to the housing 11, the product slicer 10 has a circular knife 20 mounted to the housing 11 which rotates about a knife axis located in the center of the knife 20. Additionally, the knife 20 has a knife cutting edge 22 that is located around the knife's perimeter which defines a knife cutting plane. The knife 22 may be covered by a knife cover 23, during use in order to prevent injury to the end user.

The product slicer 10 has a carriage assembly 30 is configured for reciprocating motion with respect to the knife cutting edge 22 and is slidably attached by a carriage assembly arm 32 to the housing 11. The carriage assembly 30 may include a carriage assembly handle 33 which provides a hold point for the end user, as seen in FIG. 1. During use, the carriage assembly 30 supports the product being sliced while reciprocating motion is provided manually by a user, or automatically by, for example, an electric motor, pneumatic motion system, or electromagnetic motion system.

The variability of the thickness of the sliced product is obtained through the use of an adjustable gauge plate 27 and the relative position of the gauge plate 27 with respect to a plane through the cutting knife 20 may be controlled by a depth adjustment mechanism 28. The gauge plate 27 may be adjusted between a position where the gauge plate 27 is aligned along a plane through the knife 20 to a position where the gauge plate 27 is disposed parallel to, but behind, the knife 20, where such adjustment may be done by rotating the knob 24. As is well known in the art, during use, an object to be sliced, normally reciprocatingly sliced, is disposed upon the carriage assembly 30 such that the object contacts and slides along the gauge plate 27 toward and away from the knife 20 as the carriage assembly 30 is moved toward and away from the knife 20, with the thickness of the cut of the object established by the parallel distance between the gauge plate 27 and the knife 20. In some embodiments the carriage assembly may receive various types of foods to be sliced into multiple relatively thin slices, such as deli meat, cheese, fish, potatoes, vegetables, and the like.

The carriage assembly may further support a weighted plate (i.e. an end weight) 60 that is configured to contact a top surface of an object (as discussed above, normally a food product) that rests upon the carrier 30. The weighted plate 60 is provided to dispose a compressive force upon the food product, which maintains the food product stationary as the food product is reciprocatingly brought into contact with and engages the cutting edge 22 of the knife 20. In some embodiments, the weighted plate 60 may include a plurality of engagement features 62 which are disposed to increase the force applied to the food product in contact therewith, to further minimize any potential motion of the food product as it engages the rotating knife edge 22. In some embodiments, the features 62 may be protuberances, or spikes, or a roughened surface, or other features that facilitate engagement with the food product, either by increasing the friction of the contact, providing increased localized forces (e.g. with small protuberances that contact the food product) or the like. The features 62 are disposed upon a first surface 60*a* of the weighted plate 60, i.e. the surface that faces and contacts the food product. A generally horizontal platform 15 may be provided to receive sliced materials from the carrier during operation.

The weighted plate 60 may be supported by an arm 40, which in some embodiments connects the weighted plate to the carriage assembly 30 via a shaft 38 that is supported by the carriage assembly 30. As understood with reference to FIGS. 1 and 2, the position of the arm 40 upon the shaft 38 controls the position of the weighted plate 60. The arm 40 is free to slide along the shaft, which allows the weighted plate 60 to move downwardly along the carrier as the width of the food product decreases, due to sliced material being removed from the food product with continued slices via reciprocating operation of the slicer.

The arm 40 may include a first hole 41 that allows the shaft 38 to pass therethrough and a second hole 42 (FIG. 4) that allows a second shaft 80 to pass through, as discussed below. The shaft 80 is rotatable with respect to the arm 40 and connects the arm 40 to the plate 60.

Figure 11:
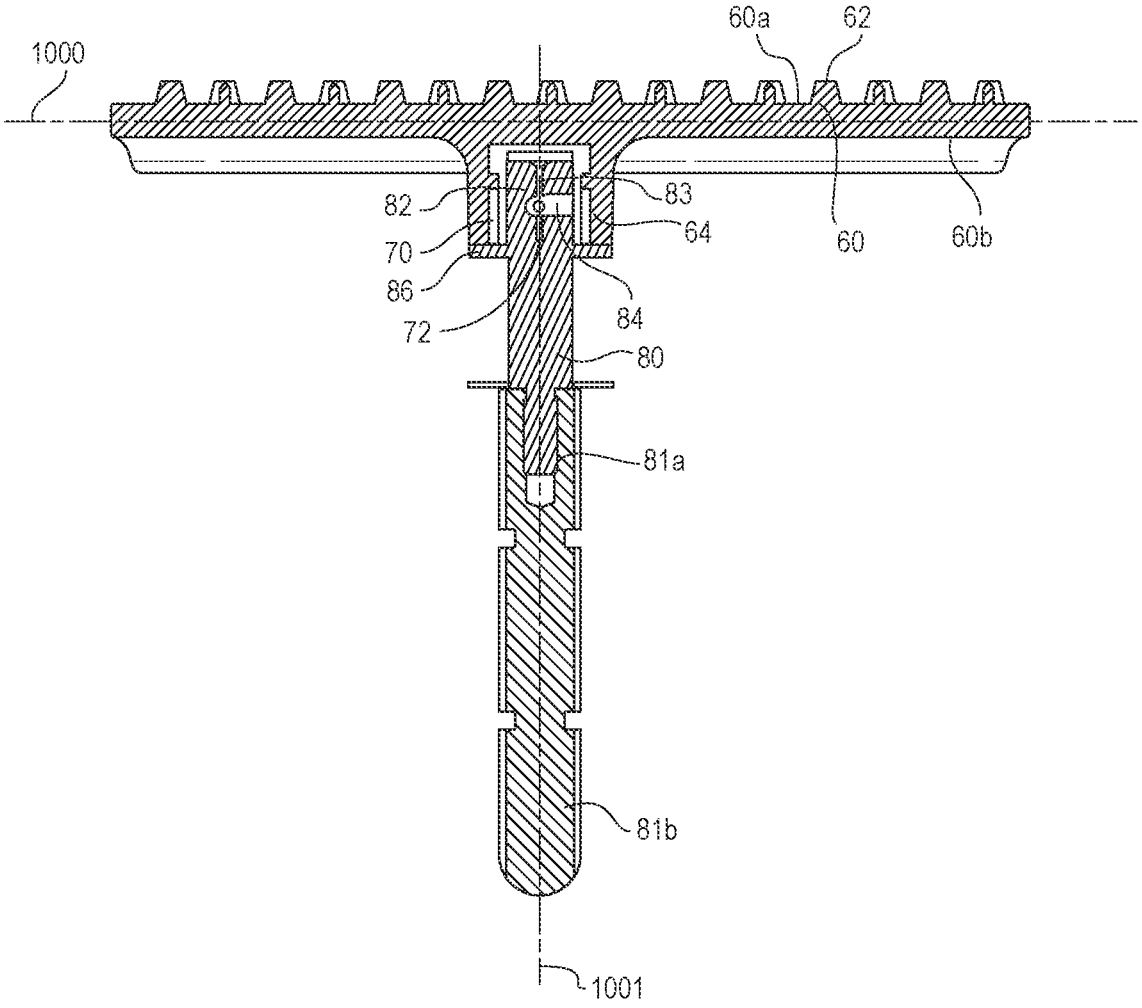
FIG. 11 is a cross-sectional view of the components of FIG. 3 with the arm removed.

The weighted plate 60 may be attached to and removed from the arm 40 by the user without the use of any external tools. FIG. 11 depicts a cross-sectional view of the components of the weighted plate, such that reference to FIG. 11 along with FIGS. 3-10 will aid a reader in understanding the disclosed system.

The weighted plate 60 is fixed with respect to the arm 40 with the following components, which will be discussed in further detail below. Specifically, the shaft 80 extends from a handle 50, which may include a flared/larger-diameter portion 51. The shaft 80 extends through the second hole 42 in the arm 40 and extends into a collar 64 that protrudes from the second surface 60*b* of the weighted plate 60.

The collar 64 extends from the rear surface 60*b* of the weighted plate 60 and includes an aperture 64*a* that extends blindly therein. The collar 64 supports a pin 72 that extends within the aperture 64*a* in a direction that is substantially parallel to a plane 1000 through the width of the weighted plate 60, as depicted in FIG. 11 (the pin 72 is depicted extending into and out of the page of FIG. 11). The term substantially parallel is specifically defined herein to mean exactly parallel as well as a range of angles from parallel plus or minus 5 degrees. In other embodiments, the pin 72 may extend at another angle with respect to the plane 1000, such as 15 or 20 degrees, as long as the pin 72 extends such that it can extend and engage within the slots 83, 84 upon the distal end portion 81*a* of the shaft 80 as discussed herein.

Figure 6:
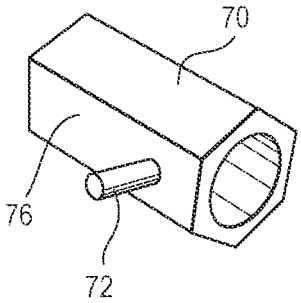
FIG. 6 is a perspective view of an insert that extends within the collar of the weighted plate of FIG. 3.
Figure 7:
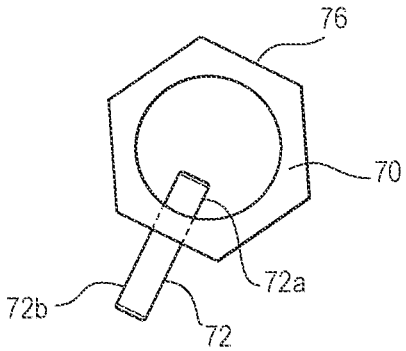
FIG. 7 is an end view of the insert of FIG. 6.
Figure 8:
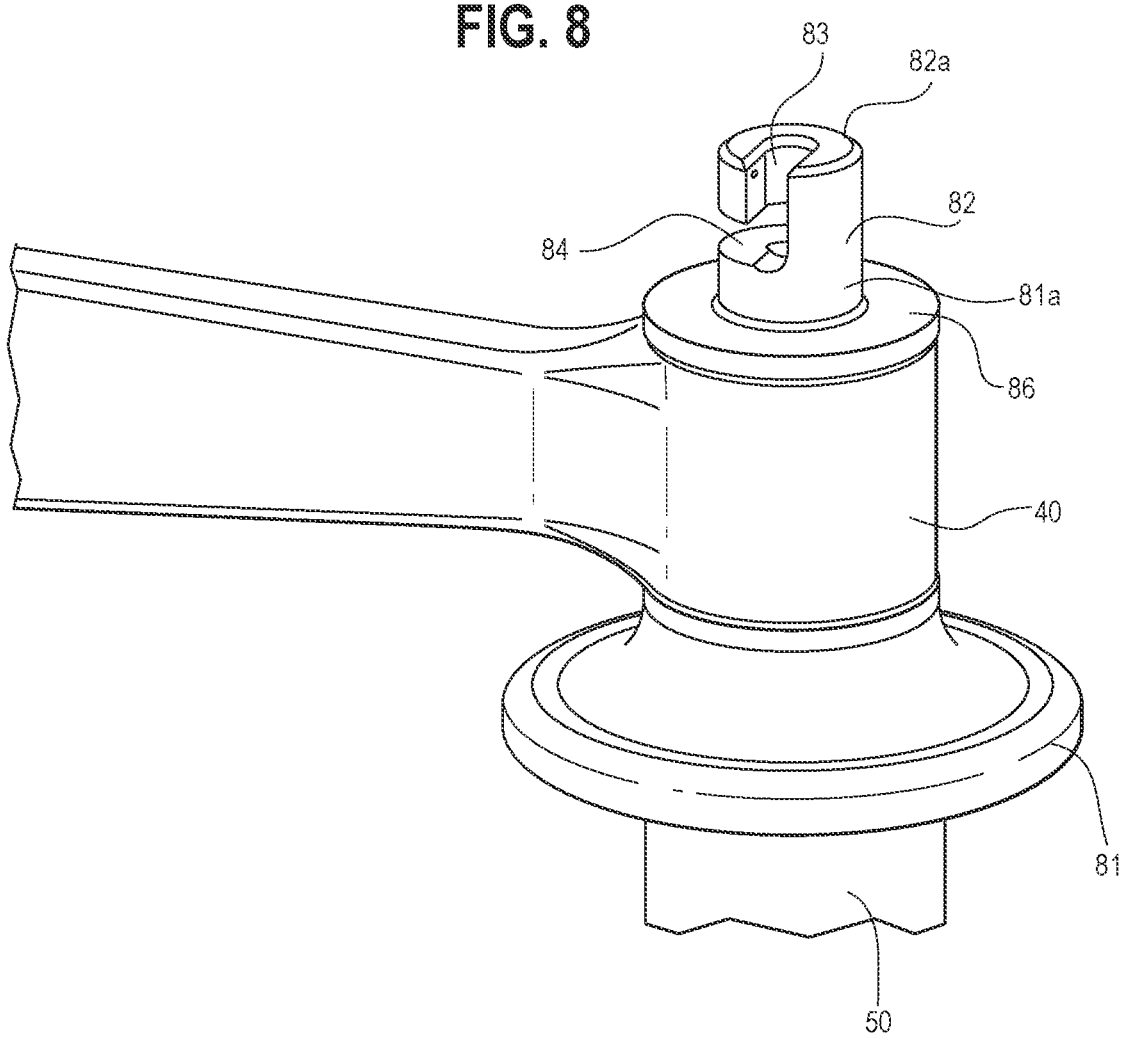
FIG. 8 is a perspective view of the distal end portion of the shaft of FIG. 5 as attached to the arm and the handle.
Figure 9:
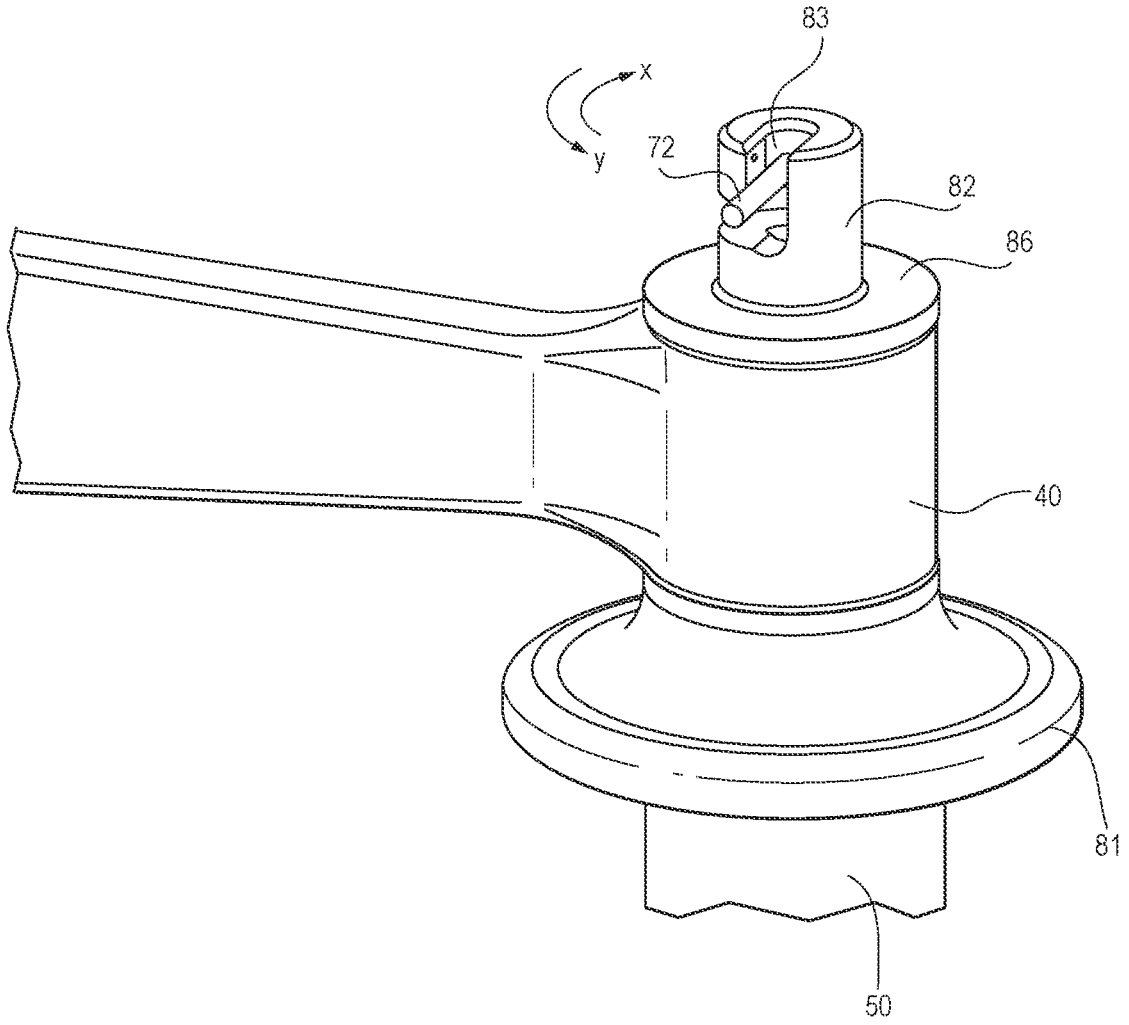
FIG. 9 is the view of FIG. 8, where a pin from the insert of FIG. 6 extends within the first slot in the distal end portion of the shaft.
Figure 10:
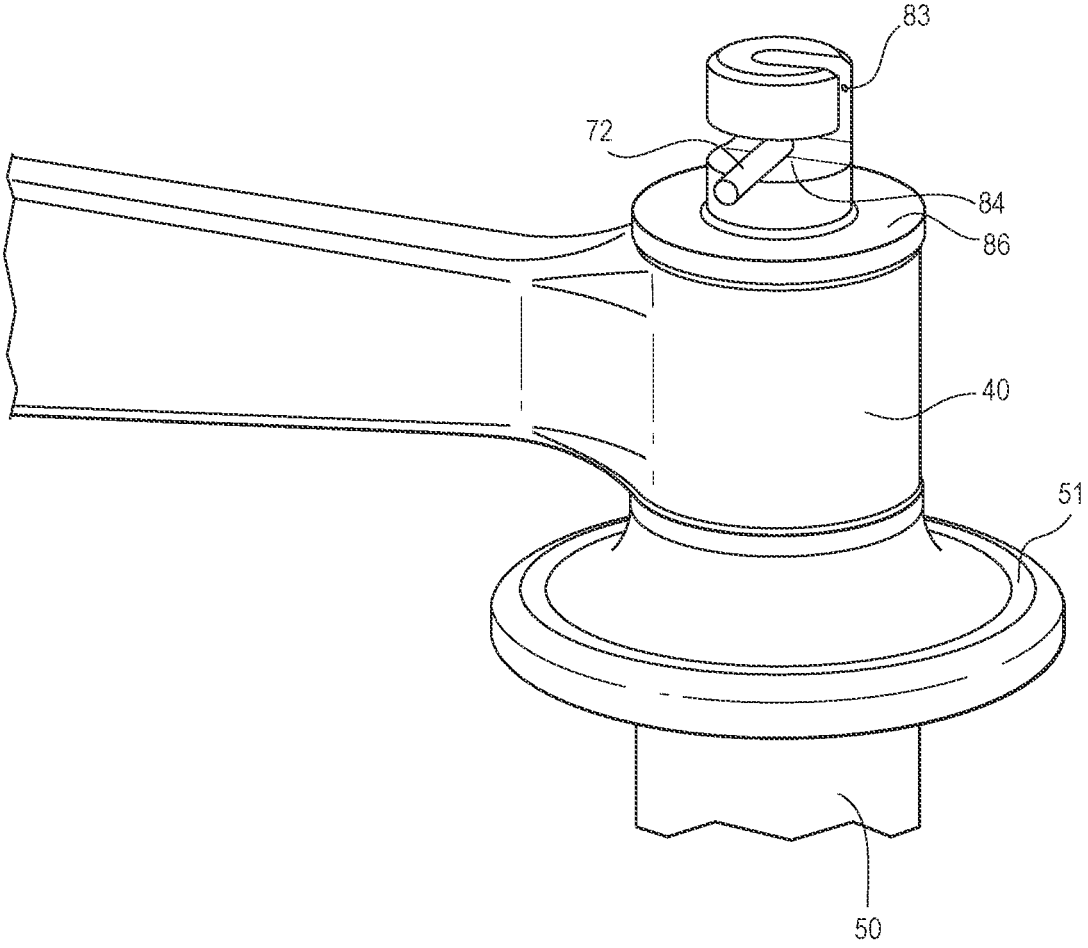
FIG. 10 is the view of FIG. 9, with the pin disposed within the second slot due to relative motion between the shaft and the insert and weighted plate.

In some embodiments, the collar 64 receives an insert 70 (FIGS. 6, 7, 11) that supports the pin within the collar 64. The insert may include one or more flats 76 and the collar 64 may be formed with a corresponding number and size of flats (not shown, but readily understandable as similar and complementary to the flats upon the insert in the figures), such that the engagement of the corresponding/complementary flats between the insert 70 and the collar 64 prevent relative motion therebetween. As shown in FIGS. 6 and 7, in some embodiments, the pin 72 may extend within a hollow cavity (72*a*) within the insert 70 (to interact with the distal end portion 81*a* of the shaft 80 as discussed below) and the pin 72 may further extend out of the insert 70. In this embodiment, the extending portion 72*b* may be received within the collar 64, such as the collar 64 over molded around the pin 72 to increase the strength of the connection between these two components. In other embodiments, the insert 70 is not provided and the collar 64 supports the pin 72 in the same manner as discussed herein. In embodiments, where the insert 70 is disposed within the collar 64, the collar 64 supports the pin 72 by virtue of its engagement with the insert 70.

Figure 4:
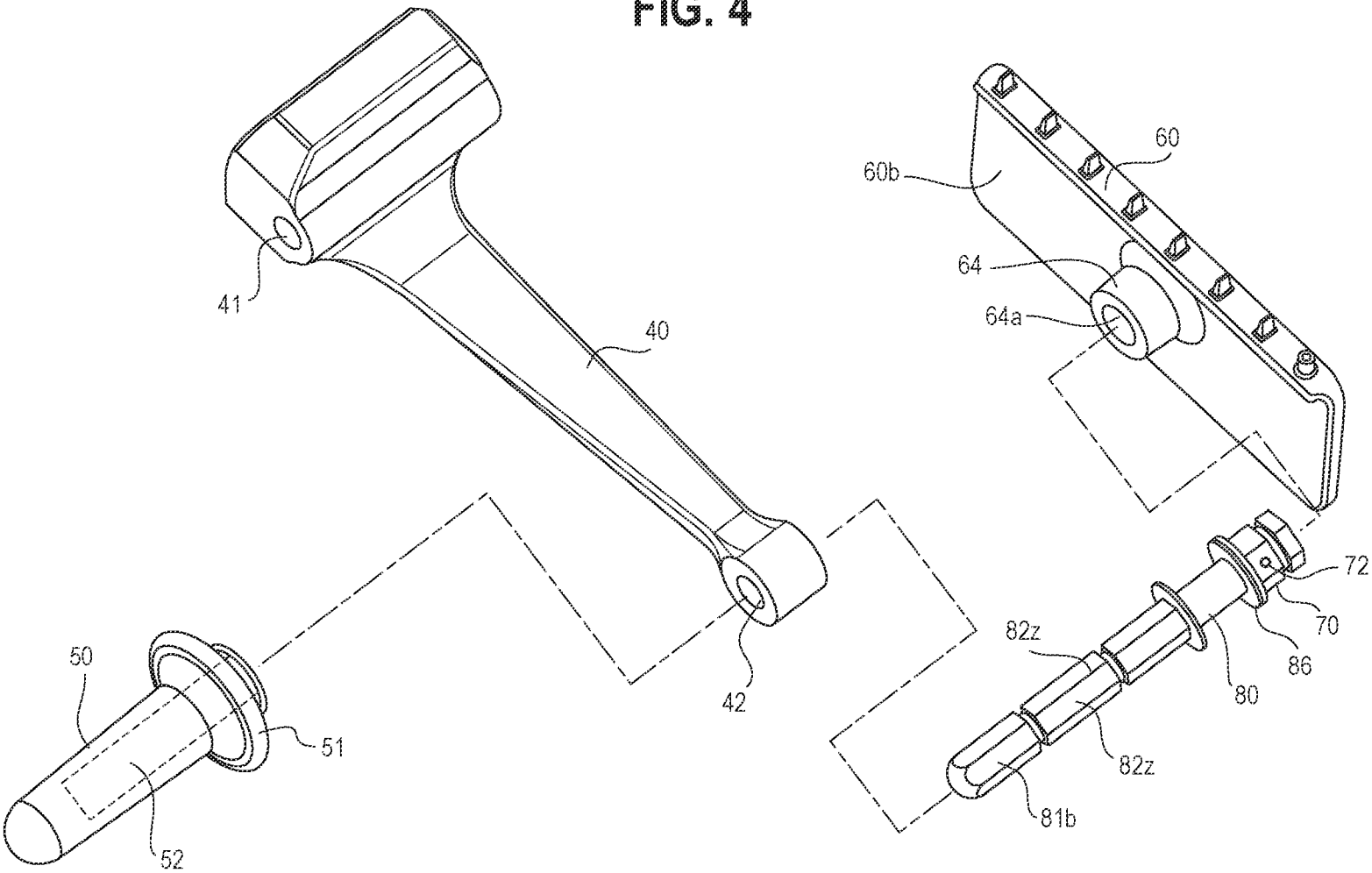
FIG. 4 is an exploded view of the arm, weighted plate, and handle of FIG. 3.
Figure 5:
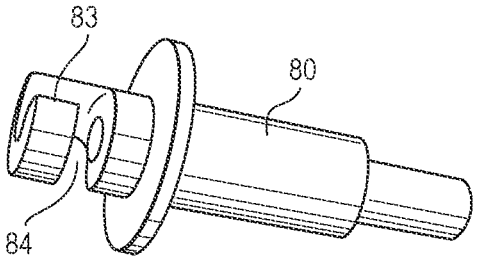
FIG. 5 is a perspective view of the distal end portion of a shaft that extends through the handle and arm and engages the weighted plate of the components of FIG. 3.

The shaft is best shown in FIGS. 4, 5, 8, and 11. The shaft 80 extends from a distal end portion 81*a* to a proximal end portion 81*b*. The proximal end portion 81*b* is received within a hole 52 in the handle 50 (shown schematically in FIG. 4 between the dashed lines within the handle 50). As depicted in FIG. 4, in some embodiments, the proximal end portion 81*b* of the shaft 80 may include a plurality of flats, 82*z*, which may be received with respect to corresponding flats (not shown but similar to flats 82*z*) of the shaft 80 to prevent relative motion between the handle 50 and the shaft 80. In some embodiments, the shaft 80 and the handle 50 may be formed as a single component (rather than an assembled component of shaft 80 and handle 50). In other embodiments, the shaft 80 and the weighted plate 60 may be formed as a single component, where the pin and slot assembly described herein with reference to collar 64 are instead disposed in the handle 50 such that those of skill in the art readily will understand that the ends of the shaft 80 are reversed relative to the drawings with the pin-slot engagement being with the handle 50 rather than the plate 60. In such an alternative embodiment, the skilled artisan will readily understand the construction with reference to the drawing figures and descriptions provided herein, with the pin/slot engagement ends being reversed between the handle and the plate (e.g., the structure shown in FIG. 5 may be on the handle end or on the plate end of the shaft, with the structure shown in FIGS. 6-7 being part of a receiving structure within the handle or being part of the plate structure). Having those structures associated with different components is readily comprehensible to those of skill in the art as informed by the present disclosure.

The shaft includes a distal end portion 81*a* that extends to a tip 82, which is configured to be inserted into the collar 64 and insert 70 (when provided) to connect the weight block 60 to the handle 50 and ultimately to the carrier 30. In embodiments where no insert 70 is provided, the tip 82 extends directly into the collar 64 and the collar 64 is sized to matingly receive the tip 82.

The tip 82 includes a diameter that is just smaller than an inner diameter of the hole within the insert 70 (or collar 64 if an insert is not provided). The tip 82 may include a first slot 83 and a second slot 84, which are connected together. The first slot 83 extends through the end face 82*a* of the tip 82 along a specific distance along the tip, and in some embodiments may extend parallel to a longitudinal axis 1001 through the shaft 80 (FIG. 11). The second slot 84 is connected to an end of the first slot (away from the end face 82*a*) and extends in a direction that is not parallel to the longitudinal axis 1001. In some embodiments, the second slot 84 may extend in a direction that is perpendicular or substantially perpendicular to the longitudinal axis 1001 of the shaft 80, while in other embodiments, the second slot 84 may extend at an oblique angle with respect to the longitudinal axis 1001, such as within a range of 45 to 135 degrees, inclusive of all angles within in this range, for example 70, 75, 80, 85, 95, 100, 105, 110 degrees from the longitudinal axis 1001. In some embodiments, the second slot may extend between about 65 and about 135 degrees inclusive of all values within this range. In some embodiments, the second slot 84 may extend in a constant direction, while in other embodiments the second slot 84 may be curved along its length (i.e. have a different angle with the longitudinal axis 1001 along its length).

The second slot 84 may have a first portion that intersects with an end portion of the first slot 83, such that a pin 72 that travels along the first slot 83 and reaches the end of the first slot enters into the second slot 84. The first and second slots 83, 84 may both be just wider than a diameter of the pin 72 to constrain the motion of the pin 72 with respect to the distal end portion 81*a* of the shaft 80 (and therefore the collar 64 (or insert 70) with respect to the shaft 80). As can be best understood with reference to FIGS. 8-11, when assembling the weighted plate 60 onto the arm 40 (and shaft 80) the weighted plate 60 is positioned such that the hole in the collar 64 and/or insert 70 is disposed in alignment with the tip 82 of the distal end portion 81*a* of the shaft 80, such that axes of these two components are aligned. The weighted plate 60 is disposed in a rotational position where the pin 72 supported by the insert 70 is aligned with the opening into the first slot 83. In some embodiments, the shaft 80 (or handle 50) and the collar 64 or weighted plate 60 may have alignment markings to assist the user at positioning the two components into a position where they are in alignment.

Once the weighted plate 60 is aligned with the shaft 80, the tip 82 is pushed into the insert 70 such that the pin 72 extends selectably into, up to through, the first slot 83. With sufficient motion, the pin 72 reaches the end of the first slot 83 and therefore the tip 82 cannot be pushed further into the insert 70 (at least with only motion in the direction of the longitudinal axis 1001). In some embodiments, the shaft 80 includes a disk 86, which contacts a bottom end of the collar 64 when the pin reaches the end of the first slot 83 as depicted in FIG. 11. After the pin 72 reaches the end of the first slot 83 (felt by the user by the disk 86 contacting the collar 64 or when not provided due the resistance to further movement by the pin 72 engaging against the bottom end wall of the first slot 83) the weighted plate 60 may be rotated in a first direction X (clockwise from top view perspective in FIG. 9) to allow the pin 72 to travel along the second slot 84. The second slot extends around an outer portion of an outer circumference of the tip 82 of the shaft 80. The weighted plate 60 may be continued to rotate in the first direction X until it reaches the end of the second slot. This establishes a connection between the weighted plate 60 and the shaft 80, handle 50, and arm 40.

In some embodiments, the second slot 84 may have an arc length such that the pin can travel through the second slot 84 with about 90 degrees of rotation, while in other embodiments, the second slot 84 may allow for about 180 degrees of rotation, while in still other embodiments, second slot 84 may have an arc length between these two values, inclusive of all values therewithin. The term "about" is specifically defined herein to include the reference value as well as plus or minus 2.5 degrees from the reference value.

In some embodiments, the shaft 80 may be positioned such that the pin 72 when at the end of the extended end of the second slot 84 (i.e. the end opposite the end that meets the first slot 83) the weight of the weighted plate 60 due to gravity urges the pin 72 into the extended end of the second slot 84, which tends to maintain the weighted plate 60 in the desired orientation (i.e. the orientation with the pin 72 at the extended end). When the user desires to remove the weighted plate 60 from the shaft 80 and arm 40, the user rotates the weighted plate 60 in the direction Y (opposite from the direction X) which moves the pin 72 through the second slot 84 and toward the first slot 83, while applying some outward force. When the pin 72 reaches the first slot 83, the outward force will move the pin 72 through the first slot 83 until it is released, which allows the tip 82 of the shaft 80 to be withdrawn from the collar 64.

While various embodiments of the present disclosure have been described, the present disclosure is not to be restricted except in light of the attached claims and their equivalents. One skilled in the relevant art will recognize that numerous variations and modifications may be made to the embodiments described above without departing from the scope of the present invention, as defined by the appended claims. Moreover, the advantages described herein are not necessarily the only advantages of the present disclosure and it is not necessarily expected that every embodiment of the present disclosure will achieve all of the advantages described.

We claim:

1. A rotating blade slicer, comprising:

a housing that rotatably supports a knife that is configured to rotate in operation of the slicer;

a carriage assembly that is slidably movable along the housing between a first position where the carriage assembly is forward of the knife and a second position where the carriage assembly is disposed over the knife;

a gauge plate that is adjustably mounted to the housing, a position of the gauge plate adjustable between a position where the gauge plate is aligned with a plane through the knife and a plurality of positions where the gauge plate is positioned parallel to the plane through the knife with a distance between a second plane through the gauge plate and the plane through the knife;

the carriage assembly movably supports a weighted plate that is slidably mounted upon the carriage assembly and is configured to be disposed upon an upper surface of a food product intended to be sliced by the knife;

the weighted plate supported by an arm that is slidably mounted to the carriage assembly, wherein the weighted plate is removably attached to the arm such that the weighted plate can be removed from and connected to the arm without any external tools; and a handle that is rotatably connected to the weighted plate, wherein the handle supports a shaft, the shaft includes a distal end portion that extends out of the handle and a proximal end portion that is disposed within the handle, wherein the distal end portion includes a slot with a first slot portion that extends from a distal end face substantially along a longitudinal axis of the shaft, and a second slot portion that extends at an angle with respect to the first slot portion, wherein the first and second slot portions are connected, wherein the weighted plate includes a first surface that is configured to contact and rest upon the upper surface of the food product, and an opposite rear surface, wherein the rear surface includes a collar that extends therefrom, wherein the collar supports a pin that extends blindly within an aperture in the collar, wherein the pin extends substantially parallel to a plane through the weighted plate, and wherein the collar supports an insert, wherein the insert supports the pin, wherein the insert includes a plurality of flats and the collar includes a corresponding plurality of flats to prevent relative rotation between the insert and the collar.

2. The rotating blade slicer of claim 1, wherein a portion of the second slot portion is disposed substantially perpendicular to the first slot portion, wherein the second slot portion fully extends to an outer circumferential surface of the distal end portion of the shaft.

3. The rotating blade slicer of claim 1, wherein the first slot portion transitions to the second slot portion with a curved portion.

4. The rotating blade slicer of claim 1, wherein the second slot portion extends from the first slot portion and around a portion of an outer circumference of the shaft.

5. The rotating blade slicer of claim 4, wherein the second slot portion extends about 180 degrees of the outer circumference of the shaft.

6. The rotating blade slicer of claim 4, wherein the second slot portion extends along an arc length that is between about 90 degrees and about 180 degrees of the outer circumference of the shaft.

7. The rotating blade slicer of claim 1, wherein the proximal end portion of the shaft includes a plurality of flats and the handle includes a hole that receives the shaft, the hole includes a corresponding plurality of flats to prevent relative rotation between the handle and the shaft.

8. The rotating blade slicer of claim 1, wherein when the shaft is extended into the collar, the pin selectably extends into the slot.

9. The rotating blade slicer of claim 1, wherein when the shaft is extended into the collar, the pin selectably extends into the slot when the shaft is disposed at a rotational position where the first slot portion is aligned with the pin.

10. The rotating blade slicer of claim 9, wherein when the first slot portion is aligned with the pin, motion of the shaft into the collar causes the pin to travel along the first slot portion, wherein when the pin reaches an end of the first slot portion, the shaft and handle may be rotated in a first direction such that the pin moves within the second slot portion in the first direction.

11. The rotating blade slicer of claim 10, wherein rotation of the handle in an opposite, second direction causes the pin to move in the second direction opposite to the first direction causes the pin to move within the second slot portion toward the first slot portion, and when the pin is aligned with the first slot portion, the shaft and handle may be pulled out of the collar.

12. A rotating blade slicer, comprising:

a housing that rotatably supports a knife that is configured to rotate in operation of the slicer;

a carriage assembly that is slidably movable along the housing between a first position where the carriage assembly is forward of the knife and a second position where the carriage assembly is disposed over the knife;

a gauge plate that is adjustably mounted to the housing, a position of the gauge plate adjustable between a position where the gauge plate is aligned with a plane through the knife and a plurality of positions where the gauge plate is positioned parallel to the plane through the knife with a distance between a second plane through the gauge plate and the plane through the knife;

the carriage assembly movably supports a weighted plate that is slidably mounted upon the carriage assembly and is configured to be disposed upon an upper surface of a food product intended to be sliced by the knife;

the weighted plate supported by an arm that is slidably mounted to the carriage assembly, wherein the weighted plate is removably attached to the arm such that the weighted plate can be removed from and connected to the arm without any external tools;

a handle that is rotatably connected to the weighted plate via a shaft configured to engage both the handle and the plate, where a first end portion of the shaft includes a slot with a first slot portion that extends from an end face of the shaft, substantially along a longitudinal axis of the shaft, and a second slot portion that extends at an angle with respect to the first slot portion, wherein the first and second slot portions are connected;

wherein a portion of the second slot portion is disposed substantially perpendicular to the first slot, wherein the second slot portion fully extends to an outer circumferential surface of the shaft, wherein the weighted plate includes a first surface that is configured to contact and rest upon the upper surface of the food product, and an opposite rear surface, wherein the rear surface includes a collar that extends therefrom, wherein the collar supports a pin that extends blindly within an aperture in the collar, wherein the pin extends substantially parallel to a plane through the weighted plate, wherein the collar supports an insert, wherein the insert supports the pin, and wherein the insert includes a plurality of flats and the collar includes a corresponding plurality of flats to prevent relative rotation between the insert and the collar.

13. The rotating blade slicer of claim 12, wherein the first slot portion transitions to the second slot portion with a curved portion.

14. The rotating blade slicer of claim 12, wherein the second slot portion extends from the first slot portion and around a portion of an outer circumference of the shaft.

15. The rotating blade slicer of claim 12, wherein the first end portion of the shaft forms an engagement with one of the handle or the weighted plate, and an opposite end of the shaft engages with the other of the handle or the weighted plate.

16. The rotating blade slicer of claim 15, where the engagement with the handle or the weighted plate includes a pin projecting into an aperture thereof and being received into the slot.

* * * * *